US010322896B2

(12) United States Patent
Furuta

(10) Patent No.: US 10,322,896 B2
(45) Date of Patent: Jun. 18, 2019

(54) SHEET SUPPORTING APPARATUS AND IMAGE FORMING APPARATUS

(71) Applicant: CANON KABUSHIKI KAISHA, Tokyo (JP)

(72) Inventor: Kiyoshi Furuta, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/825,414

(22) Filed: Nov. 29, 2017

(65) Prior Publication Data

US 2018/0162664 A1 Jun. 14, 2018

(30) Foreign Application Priority Data

Dec. 14, 2016 (JP) ..... 2016-242427

(51) Int. Cl.
*B65H 5/36* (2006.01)
*B65H 1/26* (2006.01)

(52) U.S. Cl.
CPC ..... *B65H 5/36* (2013.01); *B65H 1/266* (2013.01); *B65H 2402/32* (2013.01); *B65H 2405/121* (2013.01)

(58) Field of Classification Search
CPC ..... B65H 5/36; B65H 2402/32; B65H 2405/121; B65H 1/266; B65H 5/38
See application file for complete search history.

(56) References Cited

U.S. PATENT DOCUMENTS

| | | | | |
|---|---|---|---|---|
| 8,960,664 | B2 * | 2/2015 | Maeda | B65H 1/00 271/162 |
| 9,056,745 | B2 * | 6/2015 | Harada | B65H 5/062 |
| 9,290,340 | B2 * | 3/2016 | Yamamoto | B65H 1/266 |
| 9,758,325 | B2 * | 9/2017 | Takeuchi | B65H 1/266 |
| 9,878,862 | B2 * | 1/2018 | Maruta | B65H 1/266 |
| 9,944,478 | B2 * | 4/2018 | Kasaishi | B65H 1/04 |
| 2015/0309460 | A1 * | 10/2015 | Yamamoto | B65H 1/266 271/3.19 |

FOREIGN PATENT DOCUMENTS

| | | |
|---|---|---|
| JP | 2002-265091 A | 9/2002 |
| JP | 2006-069732 A | 3/2006 |
| JP | 2013-180864 A | 9/2013 |
| JP | 2016-183002 A | 10/2016 |

* cited by examiner

*Primary Examiner* — Patrick Cicchino
(74) *Attorney, Agent, or Firm* — Venable LLP

(57) ABSTRACT

A sheet supporting apparatus includes a first lock portion supported movably with respect to an apparatus body between a first locking position where the first lock portion locks a retention portion at a retaining position and a first releasing position where the first lock portion releases a lock of the retention portion and the first lock portion, a second lock portion supported movably with respect to the apparatus body between a second locking position where the second lock portion locks the first lock portion at the first locking position and a second releasing position where the second lock portion releases a lock of the first lock portion and the second lock portion, and a regulation portion provided on a sheet supporting portion, and configured to abut against the second lock portion positioned at the second locking position and regulate a movement of the second lock portion to the second releasing position in a state where the sheet supporting portion is attached to the apparatus body.

14 Claims, 8 Drawing Sheets

SHEET SUPPORTING APPARATUS AND IMAGE FORMING APPARATUS

BACKGROUND OF THE INVENTION

Field of the Invention

The present invention relates to a sheet supporting apparatus configured to support a sheet, and an image forming apparatus equipped with the sheet supporting apparatus.

Description of the Related Art

Generally, an image forming apparatus such as a printer is equipped with a sheet feed cassette storing sheets, a manual sheet feeding portion configured to feed a manually fed sheet, and a sheet conveyance path through which the sheet fed from the manual sheet feeding portion is conveyed. The sheet conveyance path is arranged above the sheet feed cassette. Japanese Unexamined Patent Application Publication No. 2013-180864 proposes an image forming apparatus designed such that if a sheet is jammed in the sheet conveyance path, the sheet feed cassette is drawn out, and a conveyance guide member constituting a portion of the sheet conveyance path is drawn out, to ensure a wide space for performing jam removal processing.

Since a conveyance guide member is arranged above the sheet feed cassette within the apparatus body, visibility of the conveyance guide member is poor. Therefore, Japanese Unexamined Patent Application Publication No. 2006-69732 proposes an image forming apparatus equipped with a release lever configured to release a lock of the conveyance guide member with respect to the apparatus body. If a user operates the release lever, the lock of the conveyance guide member is released and the sheet conveyance path is opened.

However, the release lever disclosed in the above-mentioned Japanese Unexamined Patent Application Publication No. 2006-69732 is configured such that it can be operated when the sheet feed cassette is attached to the apparatus body. Therefore, if the release lever is operated by the user when the sheet feed cassette is attached to the apparatus body, there was a risk of the conveyance guide member falling onto the sheet feed cassette and causing damage to the conveyance guide member or the sheet feed cassette.

SUMMARY OF THE INVENTION

According to one aspect of the present invention, a sheet supporting apparatus includes an apparatus body, a sheet supporting portion attached detachably with respect to the apparatus body, and configured to support a sheet, a conveyance guide supported movably with respect to the apparatus body between a guide position where the conveyance guide guides the sheet being conveyed above the sheet supporting portion attached to the apparatus body and a lowered position that is positioned lower than the guide position, a retention portion supported movably with respect to the apparatus body between a retaining position where the retention portion retains the conveyance guide at the guide position and an allowing position where the retention portion allows the conveyance guide to move from the guide position to the lowered position, and a regulation mechanism configured to regulate a movement of the retention portion to the allowing position from the retaining position in a state where the sheet supporting portion is attached to the apparatus body and configured to allow the retention portion to move to the allowing position from the retaining position in a state where the sheet supporting portion is removed from the apparatus body.

Further features of the present invention will become apparent from the following description of exemplary embodiments with reference to the attached drawings.

DESCRIPTION OF THE EMBODIMENTS

General Arrangement

Figure 1:
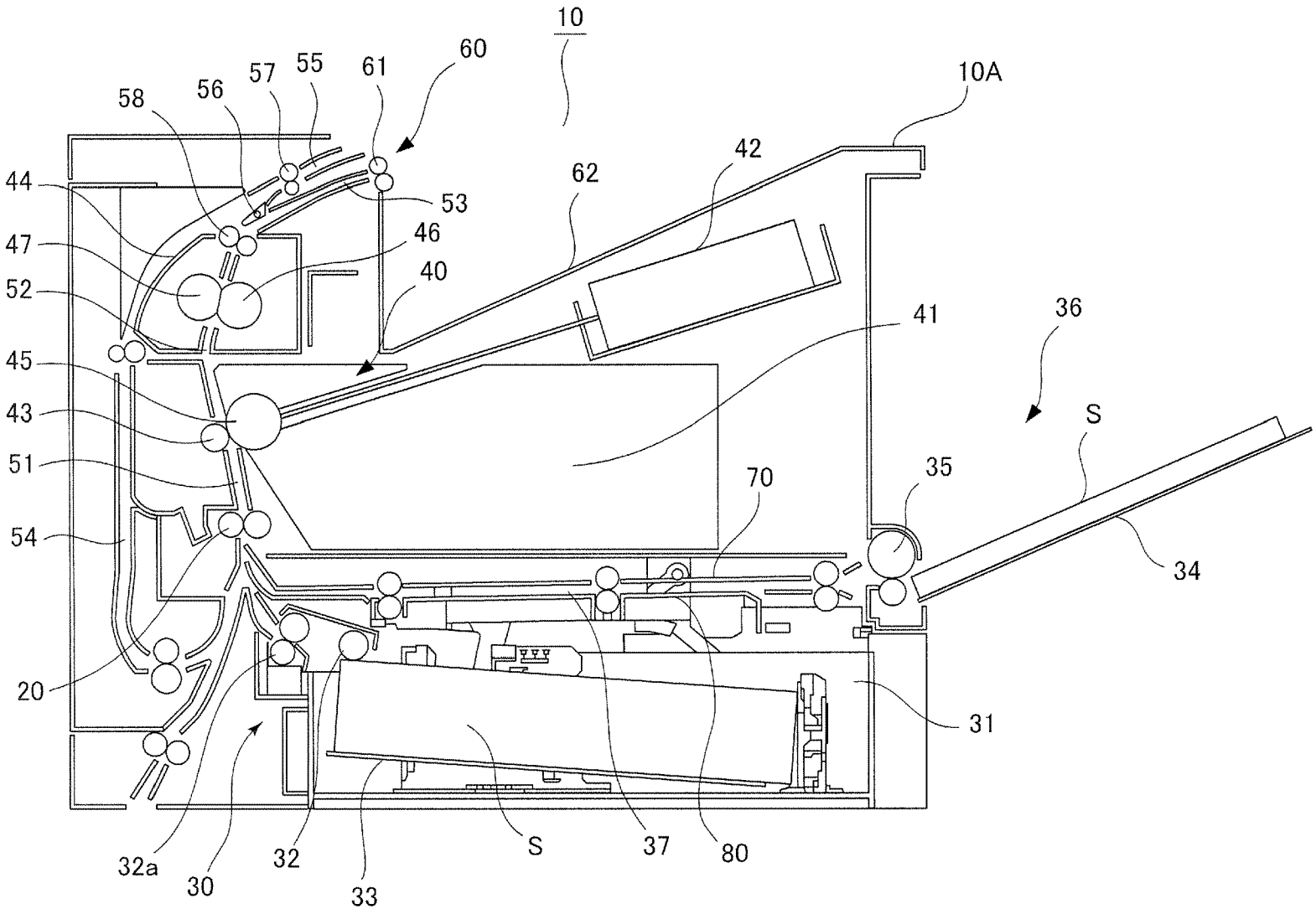
FIG. 1 is an entire schematic diagram illustrating a printer according to a present embodiment.

First, an embodiment of the present invention will be described. A printer 10 serving as an image forming apparatus is a laser beam printer adopting an electro-photographic system configured to form a monochromatic toner image. As illustrated in FIG. 1, the printer 10 includes a sheet feeding unit 30 configured to feed supported sheets, and an image forming unit 40 configured to form an image on the sheet being fed. The printer 10 further includes a fixing unit 44 configured to fix the image being transferred to the sheet, a sheet discharge portion 60 capable of discharging sheets onto a sheet discharge tray 62, and a manual sheet feeding portion 36 capable of feeding the manually fed sheet.

If an instruction to form an image is output to the printer 10, an image forming process by the image forming unit 40 is started, based on image information entered from an external computer and the like connected to the printer 10. The image forming unit 40 includes a process cartridge 41, a laser scanner 42, and a transfer roller 43. The process cartridge 41 is configured of a photosensitive drum 45 and a process unit acting on the photosensitive drum 45 which are formed as an integrated cartridge, and the process cartridge is attached in a detachable manner to a printer body 10A serving as an apparatus body.

The laser scanner 42 irradiates a laser beam toward the photosensitive drum 45 based on the entered image information. The photosensitive drum 45 is charged in advance by a charging unit not shown, and when the laser beam is irradiated on the photosensitive drum 45, an electrostatic latent image is formed on the photosensitive drum 45. Thereafter, the electrostatic latent image is developed by a developing unit not shown, and a monochromatic toner image is formed on the photosensitive drum 45.

In parallel with the image forming process, a sheet S stored in a cassette 31 serving as a sheet supporting portion of the sheet feeding unit 30 is fed by a pickup roller 32. A sheet supporting plate 33 capable of being lifted and lowered is provided on the cassette 31, and in a state where the sheets are fed, the sheet S supported on the sheet supporting plate 33 contacts the pickup roller 32. The sheet S fed by the pickup roller 32 is separated one sheet at a time by a separation roller pair 32*a*, and conveyed to a transfer conveyance path 51 toward a registration roller pair 20. Only one cassette 31 is provided in the present embodiment, but it is possible to provide a plurality of cassettes capable of supporting different sized sheets, so that sheets can be fed from a plurality of cassettes according to the selected sheet size.

Further, it is possible to feed a sheet S from the manual sheet feeding portion 36, instead of feeding the sheet S from the sheet feeding unit 30. The manual sheet feeding portion 36 includes a manual feed tray 34 configured to support a sheet S, and a feed roller 35 configured to feed the sheet S supported on the manual feed tray 34. The sheet S fed by the feed roller 35 is guided along a manual feed conveyance path 37 to the registration roller pair 20.

A toner image on the photosensitive drum 45 is transferred by electrostatic load bias applied on the transfer roller 43 on a first side, i.e., upper surface, of a sheet S subjected to skew feed correction by the registration roller pair 20 and conveyed at a predetermined conveyance timing. The sheet S on which a toner image has been transferred is subjected to predetermined heat and pressure by a heating roller 46 and a pressure roller 47 of the fixing unit 44, by which the toner is melted and fixed. The sheet S having passed through the fixing unit 44 is conveyed by a conveyance roller pair 58 to a discharge conveyance path 53, and discharged through a sheet discharge roller pair 61 to the sheet discharge tray 62.

If images are to be formed on both sides of the sheet S, a guide member 56 pivots downward, and the sheet S is guided to a reverse conveyance path 55. The sheet S guided to the reverse conveyance path 55 is switched back by a reverse conveyance roller pair 57, and conveyed to a duplex conveyance path 54. The sheet S conveyed through the duplex conveyance path 54 is conveyed again to the transfer conveyance path 51 by a plurality of conveyance roller pairs. Then, an image is formed to a second side, i.e., rear side, of the sheet S by the image forming unit 40 in a manner similar to the first side, and discharged to the sheet discharge tray 62.

Sheet Feeding Unit

Figure 2:
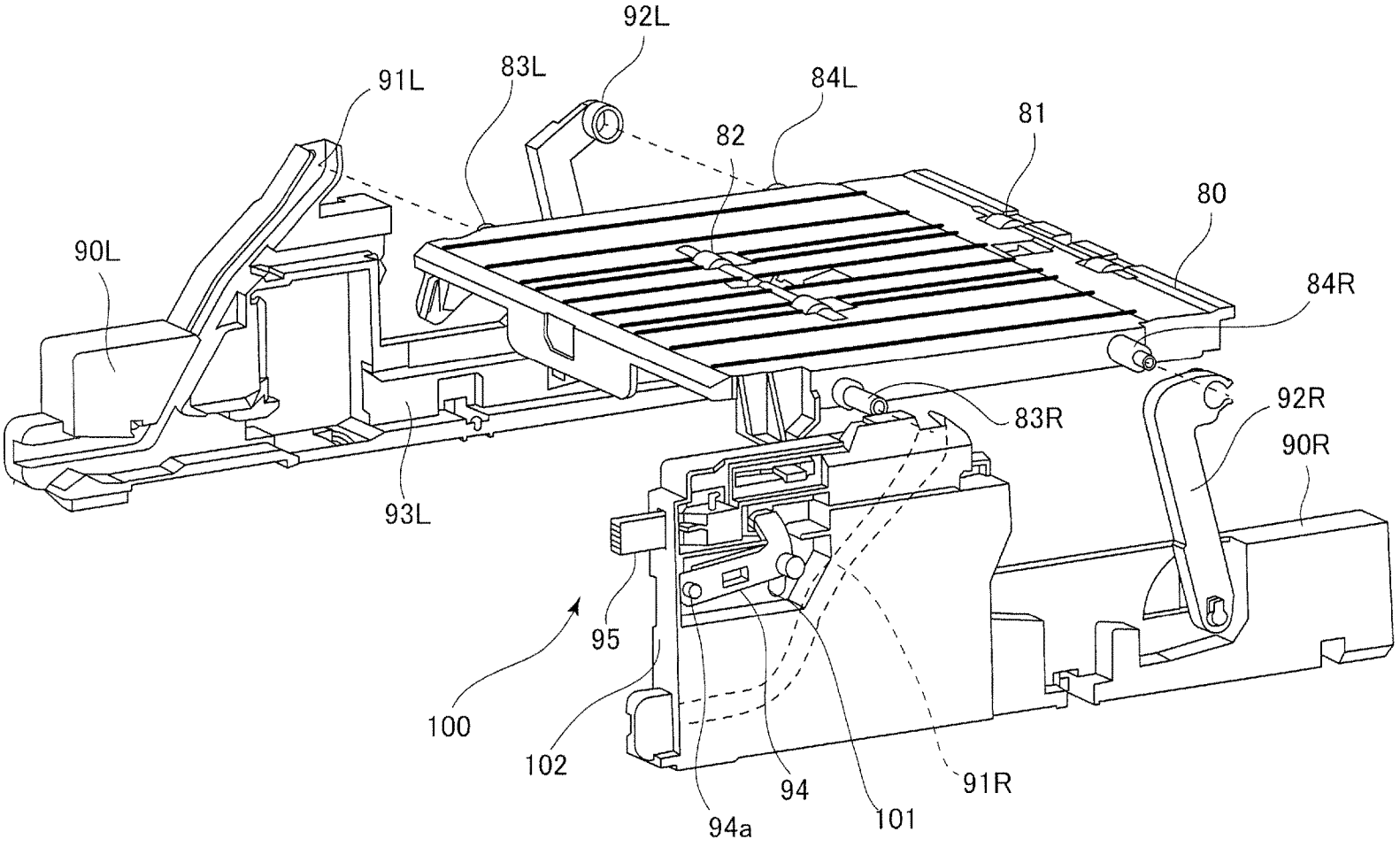
FIG. 2 is a perspective view illustrating a configuration of a sheet feeding unit.
Figure 3:
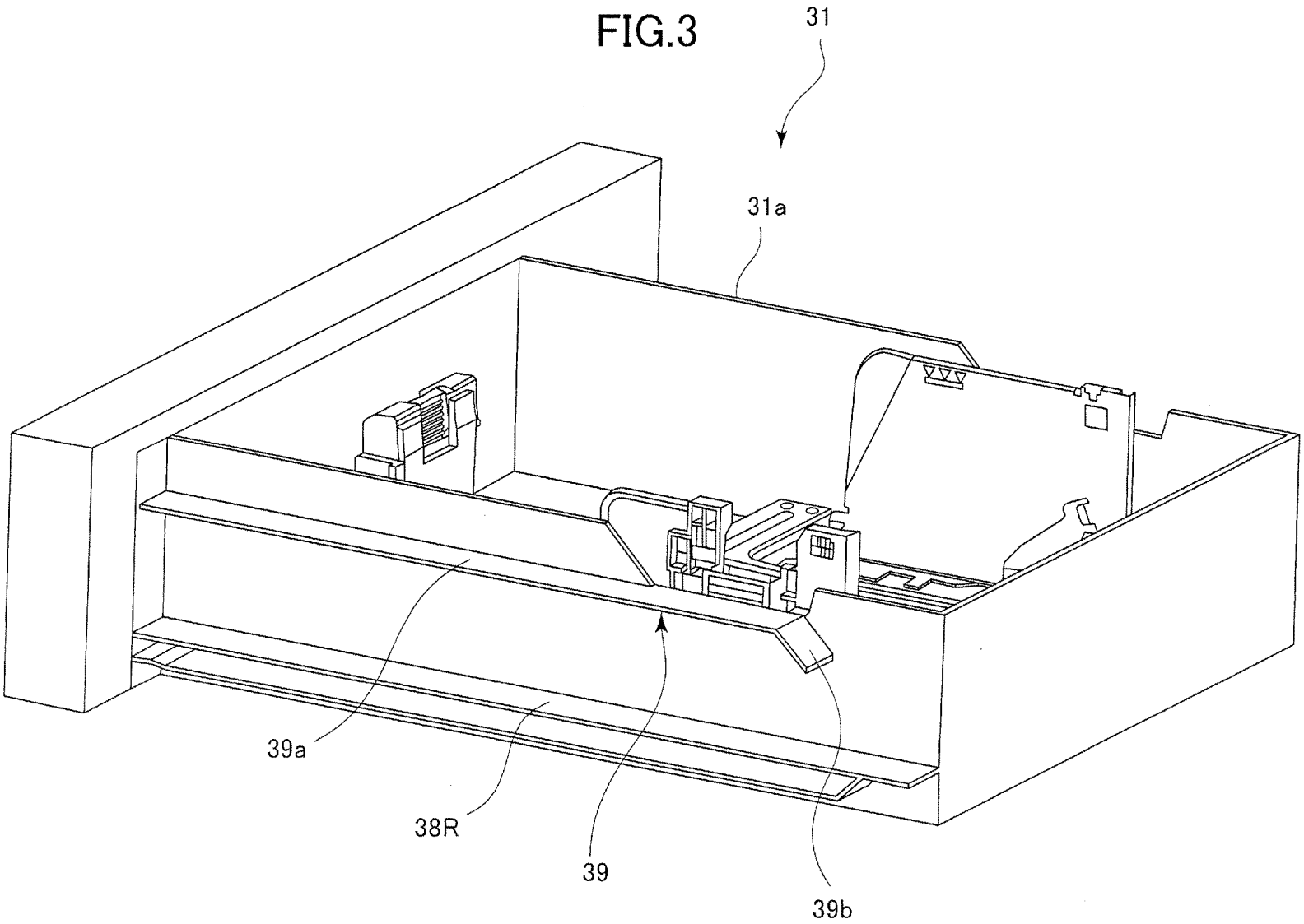
FIG. 3 is a perspective view illustrating a cassette.

As illustrated in FIGS. 2 and 3, the sheet feeding unit 30 serving as a sheet supporting apparatus includes left and right cassette guides 90L and 90R provided as a part of the printer body 10A, and a lower conveyance guide 80 constituting a portion of the manual feed conveyance path 37. Further, the sheet feeding unit 30 includes a second retention portion 75R described later (refer to FIG. 4), and a regulation mechanism 100.

In the following description, the members having reference numbers followed by the letter "L" or "R" are a pair of members, each of which is disposed on the left or the right side in a width direction orthogonal to the sheet conveyance direction, and if one of the pair of members is described, the description of the other one of the pair of members may be omitted or not shown in the drawings.

The cassette guides 90L and 90R are arranged on an outer side in the width direction of the cassette 31 attached to the printer body 10A, and guide grooves 91L and 91R and cassette guide grooves 93L and 93R are formed on inner sides in the width direction of the cassette guides 90L and 90R respectively. First rails 38L and 38R are formed on both sides in the width direction of a frame 31*a* of the cassette 31, and in a state where the first rails 38L and 38R are engaged with the cassette guide grooves 93L and 93R serving as a guide portion, the cassette 31 is guided in an attachment/detachment direction, which is approximately a horizontal direction.

Further, a second rail 39 is formed on one side of the frame 31*a* in the width direction. The second rail includes a regulating surface 39*a* extending in an attachment direction of the cassette 31, and a pressing surface 39*b* disposed in an inclined manner with respect to the regulating surface 39*a* from a downstream end of the regulating surface 39*a* in the attachment direction. That is, the pressing surface 39*b* is extended in a direction inclined with respect to the attachment direction of the cassette 31.

Figure 4:
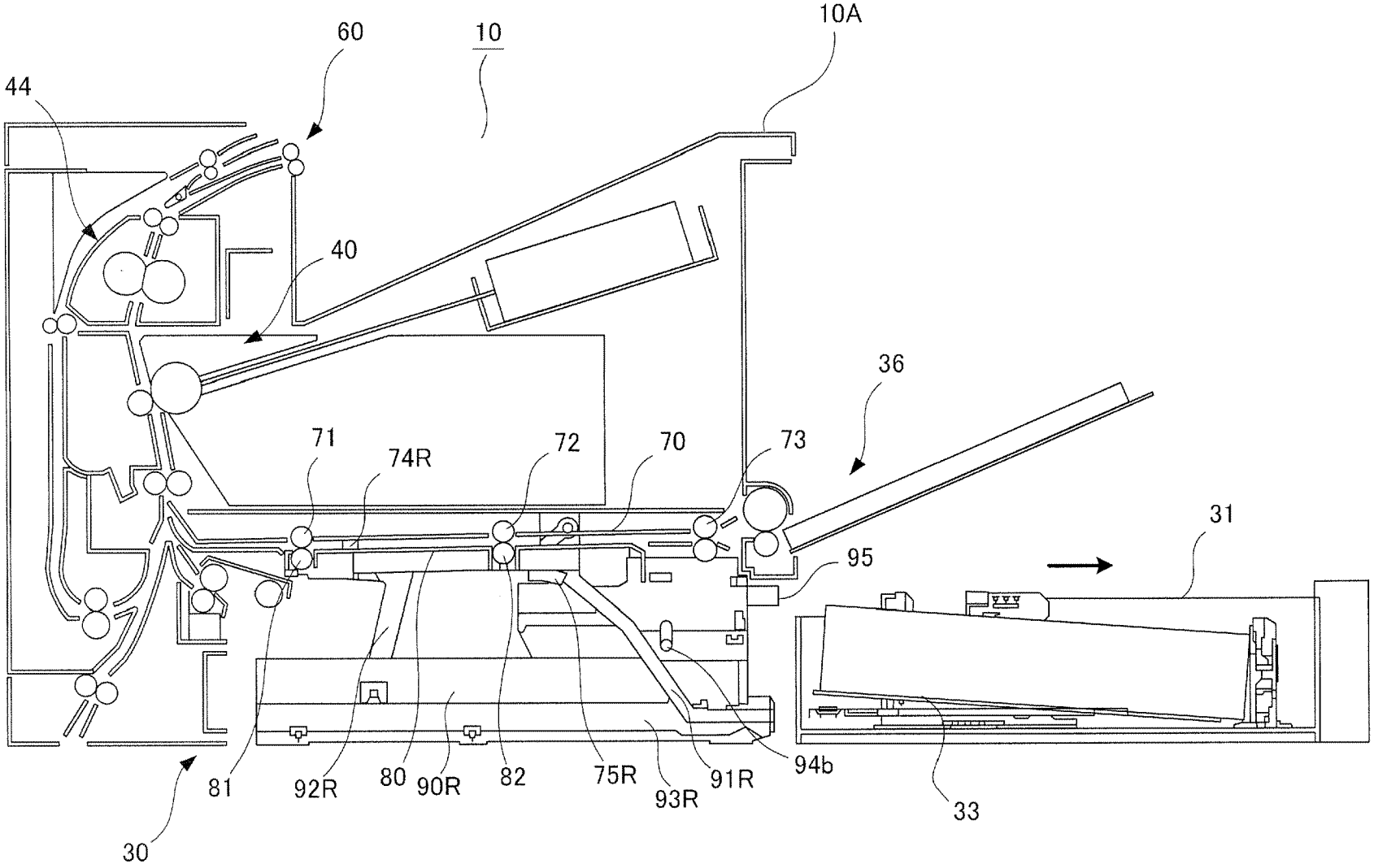
FIG. 4 is a cross-sectional view illustrating a state in which the cassette is drawn out from a printer body.

Meanwhile, as illustrated in FIGS. 2 and 4, the manual feed conveyance path 37 is composed of an upper conveyance guide 70, and the lower conveyance guide 80 serving as the conveyance guide opposed to the upper conveyance guide 70. The lower conveyance guide 80 includes projected portions 83L and 83R provided upstream in the attachment direction and projected portions 84L and 84R provided downstream in the attachment direction, which are projected from both sides in the width direction. The projected portions 83L and 83R are respectively engaged with the guide grooves 91L and 91R formed on the cassette guides 90L and 90R. The cassette guides 90L and 90R respectively pivotably support link members 92L and 92R, and the projected portions 84L and 84R are supported by a leading end portion of the link members 92L and 92R.

Figure 5:
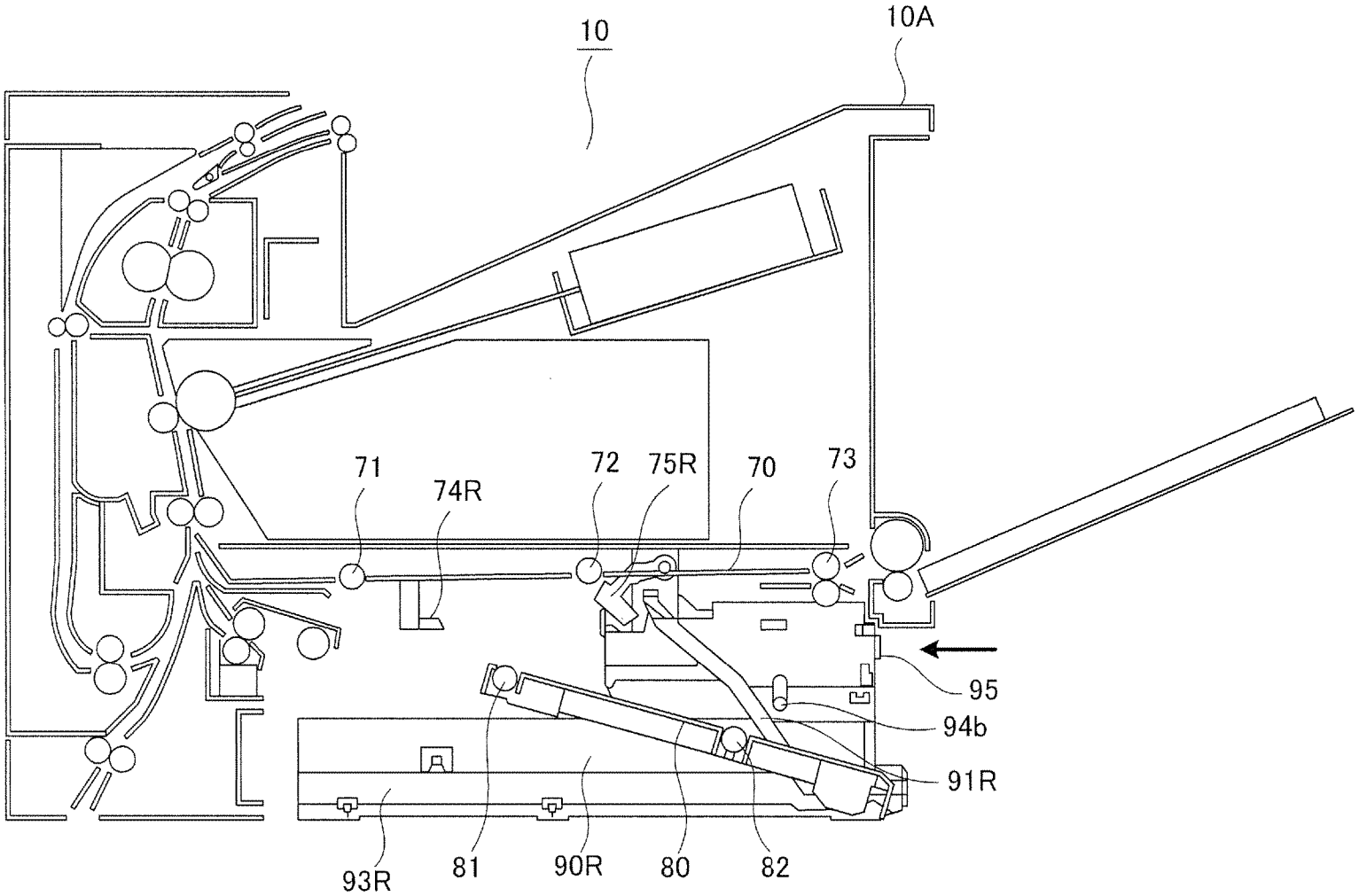
FIG. 5 is a cross-sectional view illustrating a lower conveyance guide moved to a lowered position.

That is, as illustrated in FIGS. 4 and 5, the lower conveyance guide 80 is guided between a guide position (refer to FIG. 4) and a lowered position (refer to FIG. 5) with respect to the cassette guides 90L and 90R through the guide grooves 91L and 91R and the link members 92L and 92R. The guide position is a position where the lower conveyance guide 80 constitutes a part of the manual feed conveyance path 37 above the cassette 31 which is attached to the printer body 10A and guides the sheet S fed from the manual sheet feeding portion 36. The lowered position is positioned lower than the guide position, and it is a position where the lower conveyance guide 80 interferes with the cassette 31 if the cassette is attached to the printer body 10A but does not contact the cassette 31 if the cassette is drawn out from the printer body 10A.

The upper conveyance guide 70 supports the conveyance rollers 71 and 72 in a rotatable manner, and further supports a first retention portion 74R and a second retention portion 75R. The lower conveyance guide 80 rotatably supports driven rollers 81 and 82 that are respectively driven to rotate by the conveyance rollers 71 and 72. The first retention portion 74R is capable of retaining a projected portion 84R of the lower conveyance guide 80 positioned at the guide position. The second retention portion 75R serving as a retention portion is pivotable between a retaining position where the second retention portion 75R retains a projected portion 83R of the lower conveyance guide 80 positioned at the guide position, and an allowing position where the second retention portion 75R allows the lower conveyance guide 80 to move to the lowered position so as to release the retained state of the projected portion 83R.

That is, the lower conveyance guide 80 is retained at the guide position by the first retention portion 74R, and the second retention portion 75R positioned at the retaining position. Then, if the second retention portion 75R pivots from the retaining position to the allowing position, the lower conveyance guide 80 drops by its own weight while being guided by the guide grooves 91L and 91R and the link members 92L and 92R, and moves to the lowered position.

Therefore, if a sheet is jammed in the manual feed conveyance path 37, at first, the cassette 31 is drawn out. Thereafter, a user operates a release lever 95 of the regulation mechanism 100 described later provided on the cassette guide 90R, by which the second retention portion 75R pivots from the retaining position to the allowing position. Thereby, the lower conveyance guide 80 is moved from the guide position to the lowered position, and a space is formed within the sheet feeding unit 30 to perform a jam removal processing, according to which the jam removal processing can be facilitated.

Regulation Mechanism

Next, the regulation mechanism 100, which is a main part of the present invention, will be described. The regulation mechanism 100 includes, as illustrated in FIG. 2, the release lever 95 slidable in the attachment/detachment direction of the cassette 31 with respect to the cassette guide 90R serving as the support member, and a locking member 94 pivotably supported on the cassette guide 90R.

The release lever 95 serving as a first lock portion can be moved in sliding motion between a first locking position where the release lever 95 locks the second retention portion 75R at the retaining position and a first releasing position where the release lever 95 releases the lock of the second retention portion 75R and the release lever 95. That is, if the user presses the release lever 95 in an arrow direction illustrated in FIG. from the first locking position to the first releasing position, the second retention portion 75R is configured to pivot from the retaining position to the allowing position. The release lever 95 and the second retention portion 75R can be connected directly to be interlocked with one another, or the release lever 95 and the second retention portion 75R can be connected indirectly with a different member intervened therebetween. According to the present embodiment, the release lever 95 presses the second retention portion 75R to the retaining position by the release lever 95 being returned to the first locking position, but it is also possible to provide an urging member that urges the release lever 95 to the first locking position or the second retention portion 75R to the retaining position.

The locking member 94 serving as a second lock portion is supported pivotably around a pivot shaft 94*a* with respect to the cassette guide 90R, as illustrated in FIGS. 2, 6 and 7, and a protruding portion 94*b* protruding toward an inner side in the width direction is formed on the locking member 94. An arc-shaped long hole 101 is formed around the pivot shaft 94*a* on the cassette guide 90R, and the protruding portion 94*b* of the locking member 94 passes through the long hole 101 and extends toward a middle of the sheet feeding unit 30 in the width direction. The locking member 94 is restricted from moving between the second locking position and the second releasing position by the engagement of the long hole 101 and the protruding portion 94*b*. That is, the locking member 94 pivots in up-down directions intersecting the attachment/detachment direction of the cassette 31.

The locking member 94 positioned at the upper second locking position locks the release lever 95 to the first locking position. Therefore, in a state where the locking member 94 is positioned at the second locking position, the release lever 95 cannot be moved from the first locking position to the first releasing position. Further, the locking member 94 positioned at the lower second releasing position releases the lock of the release lever 95 and the locking member 94. The protruding portion 94*b* of the locking member 94 is arranged to be able to contact the second rail 39 serving as a regulation portion provided on the cassette 31.

Figure 6A:
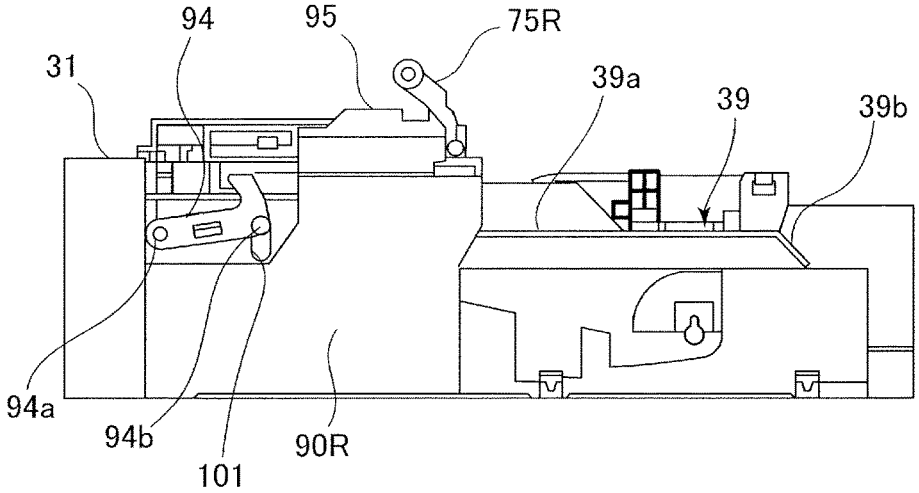
FIG. 6A is a cross-sectional view illustrating a state in which a locking member is positioned at a second locking position.
Figure 6B:
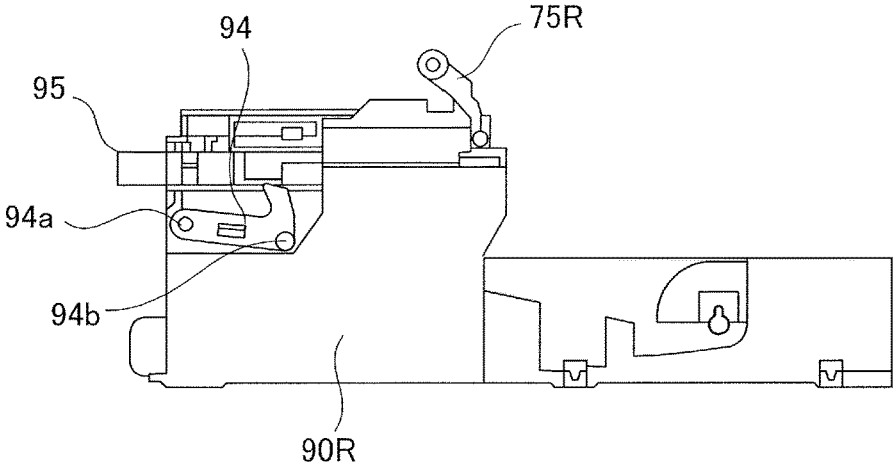
FIG. 6B is a cross-sectional view illustrating a state in which the locking member is moved to a second releasing position.
Figure 6C:
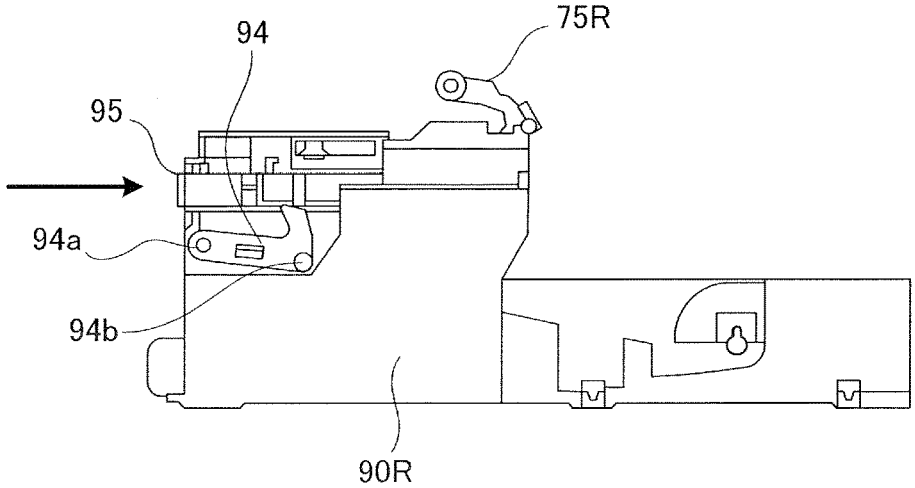
FIG. 6C is a cross-sectional view illustrating a state in which a release lever is moved to a first releasing position.
Figure 7A:
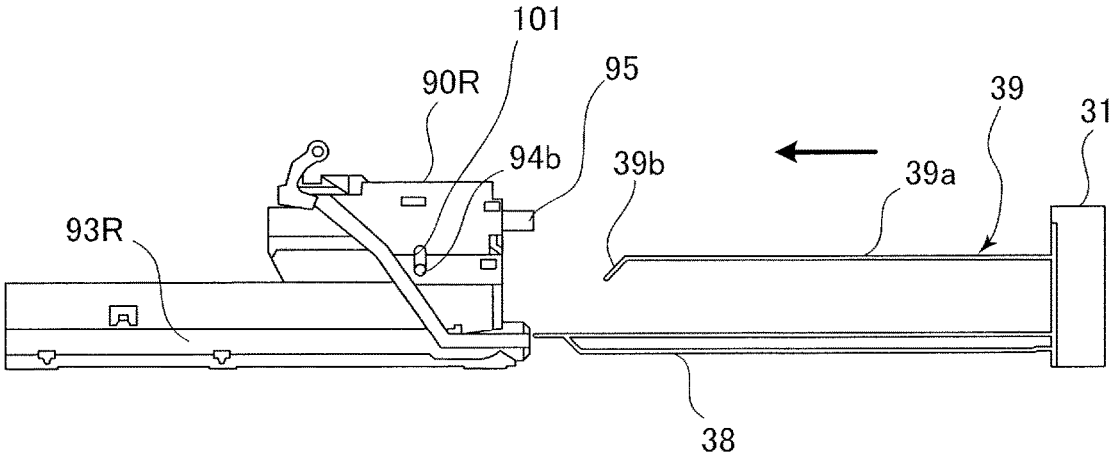
FIG. 7A is a cross-sectional view illustrating a state in which the cassette is drawn out from the printer body.

Next, with reference to FIGS. 6 and 7, the movement of the locking member 94 interlocked with the attachment and detachment operation of the cassette 31 will be described. As illustrated in FIG. 7A, in a state where the cassette 31 is drawn out from the cassette guide 90R, the second rail 39 and the protruding portion 94*b* are not in contact with each other. In this state, the locking member 94 is positioned at the lower second releasing position by its own weight, and as illustrated in FIGS. 6B and 6C, the release lever 95 can be pressed and operated.

Figure 7B:
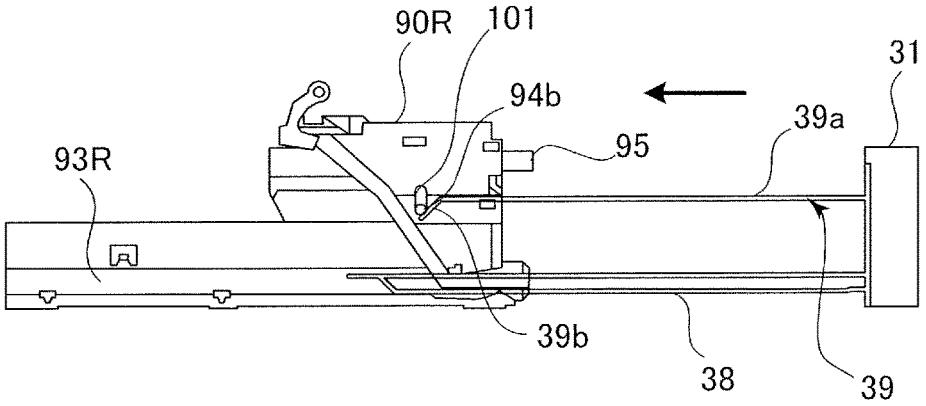
FIG. 7B is a cross-sectional view illustrating a state in which a pressing surface and a protruding portion are abutted against one another.
Figure 7C:
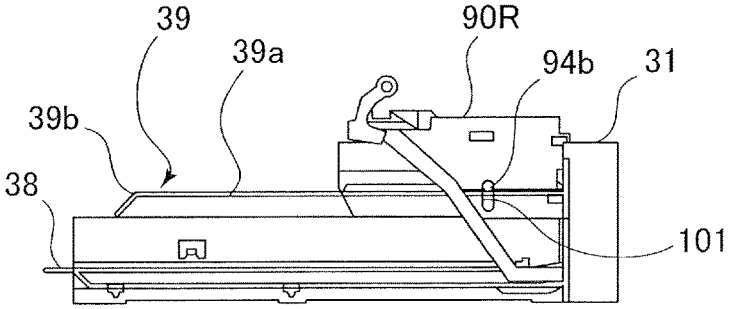
FIG. 7C is a cross-sectional view illustrating a state in which the locking member is positioned at the second locking position by a regulating surface.

Then, if the cassette 31 is moved toward the cassette guide 90R for attachment, as illustrated in FIG. 7B, at first, the pressing surface 39*b* of the second rail 39 comes into contact with the protruding portion 94*b*, and the protruding portion 94*b* moves gradually upward along the long hole 101 by the pressing surface 39*b*. Then, as illustrated in FIG. 7C, if the protruding portion 94*b* moves onto the regulating surface 39*a* from the pressing surface 39*b*, the locking member 94 will be positioned at the second locking position. At this time, the locking member 94 locks the release lever 95 to the first locking position as illustrated in FIG. 6A, so that the user cannot press and move the release lever 95 to the first releasing position. Further, the regulating surface 39*a* is extended in the attachment direction of the cassette 31, and retains the locking member 94 to the first locking position until the cassette 31 is completely attached to the printer body 10A.

As described, in the state where the cassette 31 is attached and during attachment and detachment of the cassette 31, the release lever 95 cannot be moved to the first releasing position, so that the second retention portion 75R will not move to the allowing position. Therefore, the lower conveyance guide 80 is securely retained at the guide position by the second retention portion 75R, and the lower conveyance guide 80 is prevented from falling toward the cassette 31 positioned below the lower conveyance guide 80. Therefore, it becomes possible to prevent the cassette 31 and the lower conveyance guide from being in contact with one another, and causing damage to the cassette 31 or the lower conveyance guide 80.

Further, in a state where the cassette 31 is removed from the printer body 10A, the locking member 94 moves to the second releasing position by its own weight, and the release lever 95 can be moved in sliding motion from the first locking position to the first releasing position. Then, if the user serving as an operator presses the release lever 95 to the first locking position, the second retention portion 75R is moved from the retaining position to the allowing position so as to allow the lower conveyance guide 80 to move to the lowered position, according to which jam removal processing can be facilitated.

According to the present embodiment, the lower conveyance guide 80 is moved toward the lowered position by its own weight as a result of releasing the retention of the lower conveyance guide 80 by the second retention portion 75R, but the configuration is not restricted thereto, and a configuration can be adopted where the lower conveyance guide 80 is moved toward the lowered position using an elastic member and the like.

According to the present embodiment, a configuration is adopted where the lower conveyance guide 80 is guided by guide grooves 91R and 91L and link members 92R and 92L provided on the cassette guides 90R and 90L, in order to create a wide space for performing the jam removal processing from the viewpoint of usability. However, the present embodiment is not restricted to such configuration, and any configuration can be adopted as long as the lower conveyance guide 80 can be moved.

According further to the present embodiment, the release lever 95 and the locking member 94 are supported by the cassette guide 90R, and the guide groove 91R and the cassette guide groove 93R are formed on the same cassette guide 90R. The operation of the release lever 95 can be restricted more reliably by determining the relationship of the respective members with respect to the cassette guide 90R formed as a single component, but the present embodiment is not restricted to such configuration.

According further to the present embodiment, the release lever 95 is provided on an upstream surface 102 of the cassette guide 90R in the attachment direction of the cassette 31, as illustrated in FIG. 2, to adopt a configuration that ensures a long area of movement of the release lever 95, but the release lever 95 can be arranged at any position.

According further to the present embodiment, the first rails 38L and 38R and the second rail 39 are configured as separate members, but they can be configured integrally.

Furthermore, the directions of movement of the second retention portion 75R, the release lever 95 and the locking member 94 are not restricted, they can be moved in sliding motion or pivoting motion, and any configuration can be adopted as long as the movement of the second retention portion 75R is restricted in an interlocked manner with the second rail 39 provided on the cassette 31.

Figure 8:
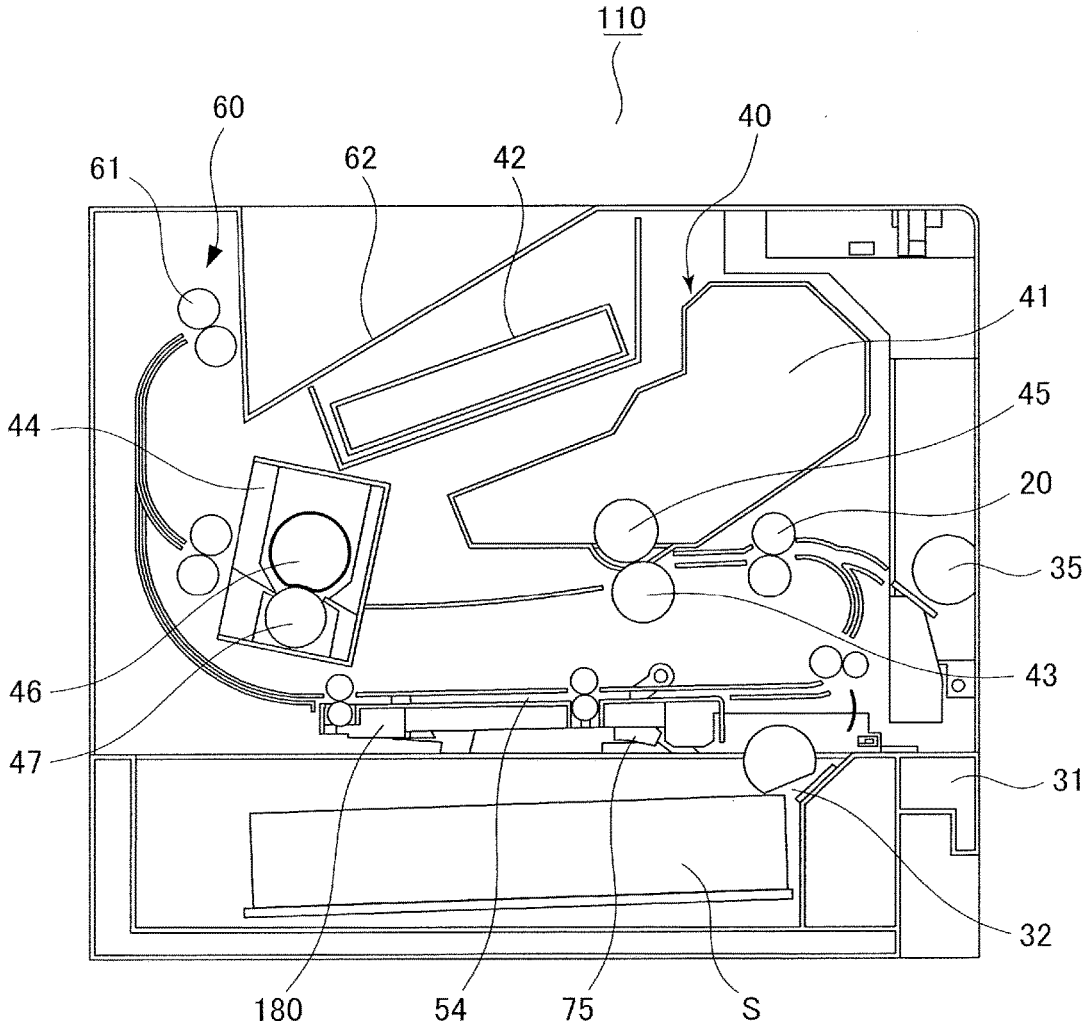
FIG. 8 is an entire schematic diagram illustrating a printer of a modified example of the embodiment.

The present embodiment adopts a configuration where the movement of the lower conveyance guide 80 constituting the manual feed conveyance path 37 is restricted, but the configuration is not restricted thereto. For example, as according to a printer 110 of a modified example illustrated in FIG. 8, the present invention can be adopted in a configuration that regulates movement of a lower conveyance guide 180 constituting the duplex conveyance path 54 through which the sheet to which an image has been formed by the image forming unit 40 is guided again to the image forming unit 40.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-242427, filed Dec. 14, 2016, which is hereby incorporated by reference wherein in its entirety.

What is claimed is:

1. A sheet supporting apparatus comprising:

an apparatus body;

a sheet supporting portion attached detachably with respect to the apparatus body, and configured to support a sheet;

a conveyance guide supported movably with respect to the apparatus body between a guide position where the conveyance guide guides the sheet being conveyed above the sheet supporting portion attached to the apparatus body and a lowered position that is positioned lower than the guide position;

a retention portion supported movably with respect to the apparatus body between a retaining position where the retention portion retains the conveyance guide at the guide position and an allowing position where the retention portion allows the conveyance guide to move from the guide position to the lowered position;

a first lock portion supported movably with respect to the apparatus body between a first locking position where the first lock portion locks the retention portion at the retaining position and a first releasing position where the first lock portion releases a lock of the retention portion and the first lock portion;

a second lock portion supported movably with respect to the apparatus body between a second locking position where the second lock portion locks the first lock portion at the first locking position and a second releasing position where the second lock portion releases a lock of the first lock portion and the second lock portion; and a regulation portion provided on the sheet supporting portion, and configured to abut against the second lock portion positioned at the second locking position and regulate a movement of the second lock portion to the second releasing position in a state where the sheet supporting portion is attached to the apparatus body.

2. The sheet supporting apparatus according to claim 1, wherein the first lock portion is movable between the first locking position and the first releasing position by an operation performed by an operator, and if the first lock portion is moved to the first releasing position in a state where the sheet supporting portion is removed from the apparatus body, the conveyance guide moves toward the lowered position.

3. The sheet supporting apparatus according to claim 1, wherein the regulation portion comprises a regulating surface extending in an attachment direction of the sheet supporting portion and capable of retaining the second lock portion to the second locking position.

4. The sheet supporting apparatus according to claim 3, wherein the regulation portion comprises a pressing surface extending in a direction inclined to the attachment direction from a downstream end of the regulating surface in the attachment direction, and pressing the second lock portion to the second locking position from the second releasing position in a state where the sheet supporting portion is being attached to the apparatus body.

5. The sheet supporting apparatus according to claim 1, wherein the apparatus body comprises a support member configured to support the first lock portion and the second lock portion, and the support member comprises a guide portion configured to guide the sheet supporting portion such that the sheet supporting portion is attached to and detached from the support member.

6. The sheet supporting apparatus according to claim 5, wherein the support member supports the first lock portion slidably to an attachment/detachment direction of the sheet supporting portion, and supports the second lock portion pivotably in a direction intersecting the attachment/detachment direction.

7. The sheet supporting apparatus according to claim 5, wherein the support member is arranged on an outer side of the sheet supporting portion attached to the apparatus body in a width direction orthogonal to a sheet conveyance direction, and the second lock portion comprises a protruding portion that passes through a long hole formed on the support member and extends inward in the width direction, and configured to abut against the regulation portion.

8. The sheet supporting apparatus according to claim 5, wherein the first lock portion is provided on an upstream surface of the support member in an attachment direction of the sheet supporting portion.

9. The sheet supporting apparatus according to claim 1, further comprising a manual sheet feeding portion configured to convey a sheet manually inserted, wherein the conveyance guide guides the sheet fed from the manual sheet feeding portion.

10. An image forming apparatus comprising:

a sheet supporting apparatus comprising:

an apparatus body;

a sheet supporting portion attached detachably with respect to the apparatus body, and configured to support a sheet;

a conveyance guide supported movably with respect to the apparatus body between a guide position where the conveyance guide guides the sheet being conveyed above the sheet supporting portion attached to the apparatus body and a lowered position that is positioned lower than the guide position;

a retention portion supported movably with respect to the apparatus body between a retaining position where the retention portion retains the conveyance guide at the guide position and an allowing position where the retention portion allows the conveyance guide to move from the guide position to the lowered position;

a first lock portion supported movably with respect to the apparatus body between a first locking position where the first lock portion locks the retention portion at the retaining position and a first releasing position where the first lock portion releases a lock of the retention portion and the first lock portion;

a second lock portion supported movably with respect to the apparatus body between a second locking position where the second lock portion locks the first lock portion at the first locking position and a second releasing position where the second lock portion release a lock of the first lock portion and the second lock portion;

a regulation portion provided on the sheet supporting portion, and configured to abut against the second lock portion positioned at the second locking position and regulate a movement of the second lock portion to the second releasing position in a state where the sheet supporting portion is attached to the apparatus body; and an image forming unit configured to form an image on a sheet fed from the sheet supporting apparatus.

11. The image forming apparatus according to claim 10, wherein the conveyance guide guides the sheet on which an image has been formed by the image forming unit to the image forming unit again.

12. A sheet supporting apparatus comprising:

an apparatus body;

a sheet supporting portion attached detachably with respect to the apparatus body, and configured to support a sheet;

a conveyance guide supported movably with respect to the apparatus body between a guide position where the conveyance guide guides the sheet being conveyed above the sheet supporting portion attached to the apparatus body and a lowered position that is positioned lower than the guide position;

a retention portion provided separately from the conveyance guide and supported pivotably around a pivot center on the apparatus body between a retaining position where the retention portion contacts and retains the conveyance guide at the guide position and an allowing position where the retention portion is separated from the conveyance guide and allows the conveyance guide to move from the guide position to the lowered position; and a regulation portion provided on the sheet supporting portion and configured to regulate movement of the retention portion to the allowing position from the retaining position in a state where the sheet supporting portion is attached to the apparatus body and being detached from the apparatus body.

13. The sheet supporting apparatus according to claim 12, wherein the regulation portion comprises a regulating surface extending in an attachment direction of the sheet supporting portion and capable of retaining the retention portion to the retaining position.

14. The sheet supporting apparatus according to claim 13, wherein a length of the regulating surface is longer than one third of a length of the sheet supporting portion and shorter than or equal to the length of the sheet supporting portion in the attachment direction.

* * * * *